United States Patent [19]

Pepin

[11] Patent Number: 4,913,424

[45] Date of Patent: Apr. 3, 1990

[54] SLANT BOARD WITH AUTOMATIC FOOT RELEASE

[76] Inventor: Rene A. Pepin, P.O. Box 712, Trinidad, Colo. 81082

[21] Appl. No.: 306,206

[22] Filed: Feb. 2, 1989

Related U.S. Application Data

[63] Continuation of Ser. No. 74,165, Jul. 6, 1987, abandoned.

[51] Int. Cl.[4] ..... A63B 23/02

[52] U.S. Cl. ..... 272/144; 272/145

[58] Field of Search ..... 272/144, 143, 145; 128/25 R, 69, 70, 28; 269/323, 328; 403/105, 106, 374

[56] References Cited

U.S. PATENT DOCUMENTS

| | | | |
|---|---|---|---|
| 968,112 | 8/1910 | Bernard | 403/105 X |
| 2,176,342 | 10/1939 | Hoppe | 272/144 |
| 2,727,767 | 12/1955 | Lehman et al. | 403/105 |
| 2,828,172 | 3/1958 | McDonald | 269/323 |
| 3,081,085 | 3/1963 | Girolamo | 128/70 |
| 3,286,708 | 11/1966 | Gartner | 272/145 X |
| 3,502,358 | 3/1970 | Alspaugh | 403/105 |
| 3,589,358 | 6/1971 | Megal | 272/145 X |
| 3,806,109 | 4/1974 | Weber et al. | 269/323 |
| 4,141,117 | 2/1979 | Van Gompel | 403/374 X |
| 4,216,568 | 8/1980 | Anderson | 403/374 X |
| 4,232,662 | 11/1980 | Barber | 272/144 X |
| 4,438,761 | 3/1984 | McGowen | 272/145 X |
| 4,444,178 | 4/1984 | Kuo | 272/145 X |
| 4,512,572 | 4/1985 | Hamm | 272/144 |
| 4,531,731 | 7/1985 | Law | 272/145 |
| 4,672,697 | 6/1987 | Schürch | 272/145 X |

*Primary Examiner*—Richard J. Apley
*Assistant Examiner*—H. Flaxman
*Attorney, Agent, or Firm*—Birch, Stewart, Kolasch & Birch

[57] ABSTRACT

A table for holding a body which lies thereon is pivoted on a transverse horizontal axis supported by a vertical upright attached and part of a stationary base frame. A cylinder connecting the base frame and table and parallel to the supporting vertical upright, when actuated by the operator via a remote controlled electrical switch, causes the table to rotate upon the horizontal axis from a horizontal position to a near vertical position.

4 Claims, 3 Drawing Sheets

SLANT BOARD WITH AUTOMATIC FOOT RELEASE

This application is a continuation of application Ser. No. 07/074,165 filed on July 6, 1987, now abandoned.

BACKGROUND OF THE INVENTION

The present invention relates generally to devices for the therapeutic treatment and exercising of the human body.

It has heretofore been generally known that certain types of body exercising and treatment devices, if properly designed and operated, can produce desirable and healthful therapeutic results upon the human body. In this category, devices for moving the human body between upright and inverted positions have been found to be particularly beneficial. Supporting the human body in an inverted position from the lower limbs tends to produce a lengthening of the body; to separate the joint spaces, especially the intervertebral joint spaces; to aid in the elimination of vascular and visceral ptosis; to decompress the body; to aid circulatory exchange; and to readjust the lines of stress of the body.

A variety of devices have heretofore been known in which a body could be moved from upright to inverted positions.

The prior art devices differ primarily in the structural design of the parts for embracing and holding the lower body extremities to permit the body inversion, and while such function is in general realized, the prior art devices have, in the main, embodied inherent disadvantages as well as problems attending their use. For example, in a number of these devices it was difficult for one person to use the device without the assistance of another person to aid in placement of the body in the device and in the engagement of the lower body supporting means. In other prior art devices it was difficult for the user to tile the body supporting structure without assistance.

One of the most prominent difficulties of the prior art devices resides in the inability of the holding means for the lower extremities to hold these extremities comfortably for extended periods of time, or to be able to effectively engage the lower extremities in a manner to prevent undesirable slippage during transitional movement of the body supporting structure between body upright and body inverted positions.

SUMMARY OF THE INVENTION

The present invention is concerned with the provision of an improved therapeutic device which can be operated with ease and without assistance to support and position the human body between horizontal and inverted positions, and in which the holding means for the lower extremities requires no effect or movement on the users part beyond proper positioning of the lower extremities.

With the foregoing in mind, it is one object of the herein described invention to provide an improved therapeutic device by means of which an unskilled person can support and move his body through tilting movements between a horizontal position and an inverted position, stopping at any degree in between.

A further object is to provide a device for the foregoing purpose which is economical to manufacture, which is designed as a unit for safety and stability and which requires no adjustment and readily accommodates the variants of size of the human body.

Another object of the invention is to provide, in a therapeutic device of the type in which the body is tilted into inverted positions, improved holding means for the feet and ankle portions of the body, which provide a cushion support, and which automatically adjusts to fit the user's extremities, whereby these extremities will be comfortably embraced and held during lengthy periods of body inversion.

Still another object is to provide improved means for orienting the body on the body supporting structure without concern to a balanced relationship to the pivotal support of the body supporting structure, to the end that the user may vary the tilted position of the body supporting structure merely by actuating a switch.

A still further object resides in the provision of improved means for embracing the ankle and instep portions of the user's body, and in which the embracing elements will be releasably locked as the table tilts from a horizontal position and automatically releases when the table is returned to the horizontal position; permitting the user to dismount from the device.

Further objects and advantages of the invention will be brought out in the following part of the specification, wherein the detailed description is for the purpose of fully disclosing a preferred embodiment of the invention without placing limitations thereon.

DETAILED DESCRIPTION OF THE DRAWINGS

Figure 1:
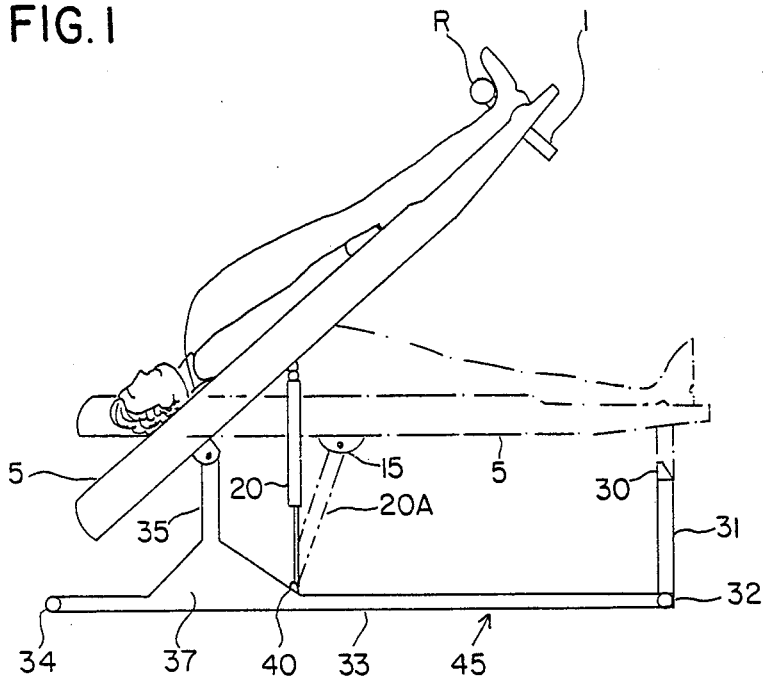
FIG. 1 is a side view showing the invention in elevated position and ghosted in a horizontal position at rest.
Figure 2:
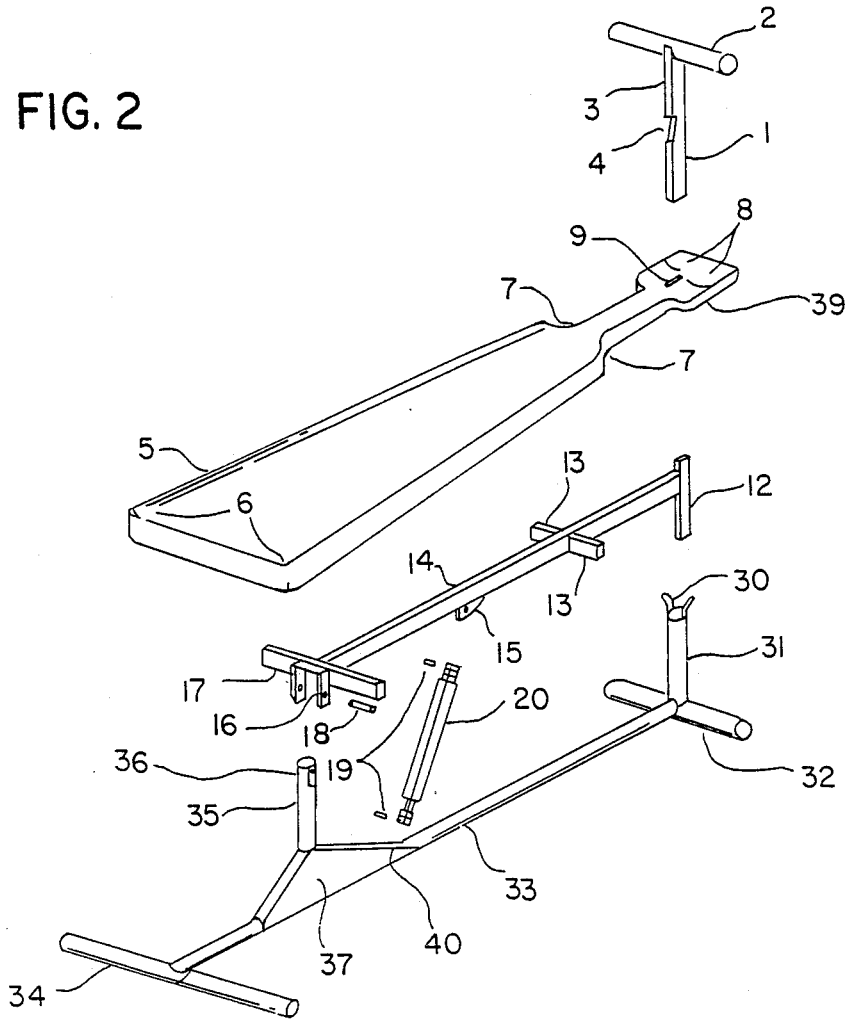
FIG. 2 is an exploded isometric view of the major components in order of assembly.

Referring to FIGS. 1 and 2, reference number 55 relates to a tilting bed as a whole, supported by two vertical parallel uprights 31 and 35. Bed 55 comprises a tubular table frame 50 to which a molded fiberglass table 5 is fastened, said table 5 being suitably contoured and padded to allow a person to lie comfortably thereon. As shown in FIG. 2, the table 5 is supported by a table subframe main beam 14, two right angle table supports 13 and a table frame cross member 17, all of which are integrally connected with each other. A slip tube 12 is connected to one end of the table subframe main beam 14. The opening in the slip tube 12 is aligned with the slip tube opening 9 in the table top 5. A T-bar vertical shaft 1 passes downwardly through the opening 9 and the slip tube 12. At one end of the frame is a T-bar 60 adjustable in height with respect to the tubular table frame 50.

The horizontal member 2 of the instep embracing T-bar is intended to hold patients ankles. The table frame 50 is pivoted so as to be able to rotate around a horizontal axis 36 mounted on one upright 35 of the tubular base frame 45.

FIG. 1 shows the table in a raised position with cylinder 20 extended and pivotally connected to the base frame 45 at the intersection of the main tubular frame member 33 and the forward extreme of the box section 37 at point 40. At the top end of the cylinder a like connection is made to the tubular table frame 50 at point 15.

The ghosted drawing shows the table at rest in a horizontal position with the cylinder 20A retracted.

FIGS. 3 through 7 show the T-bar device for securing the lower extremities.

Figure 5:
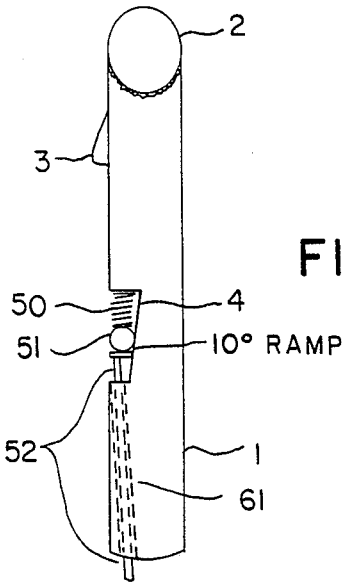
FIG. 5 is a side view of the foot embracing mechanism turned 90° in relationship to FIG. 3.
Figure 6:
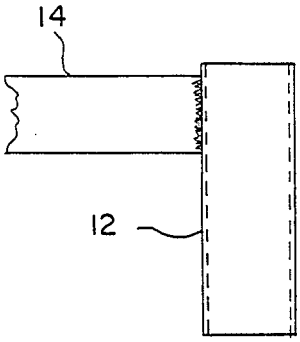
FIG. 6 is a side view of the vertical slip tube through which the vertical bar of the T-bar slides.
Figure 7:
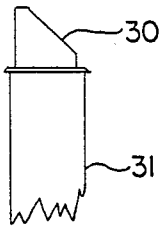
FIG. 7 is a side view of the table alignment yoke in FIG. 4.
Figure 8:
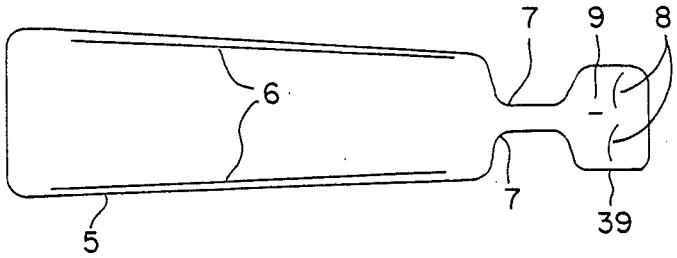
FIG. 8 is a top plan view of the bed.
Figure 9:
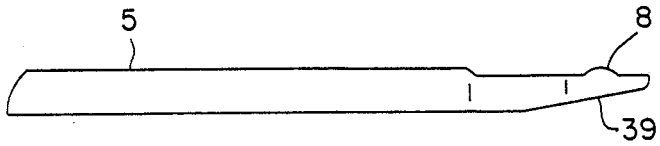
FIG. 9 is a side elevation of FIG. 8.
Figure 10:
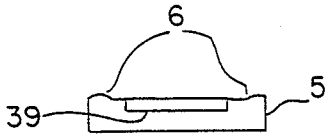
FIG. 10 is the front elevation of the bed shown in FIGS. 8 and 9.
Figure 11:
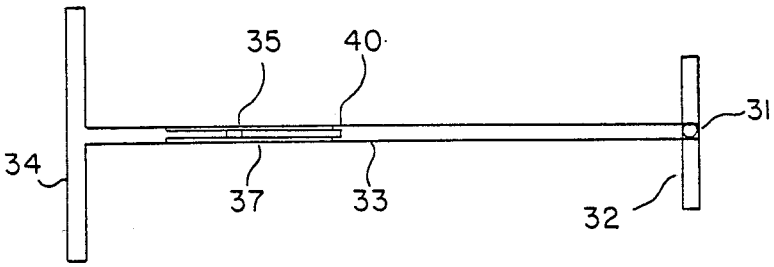
FIG. 11 is a top plan view of the base frame.
Figure 12:
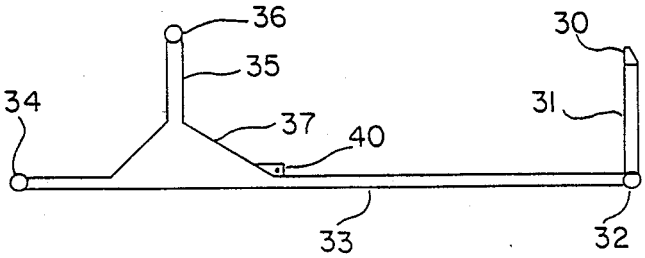
FIG. 12 is a side elevation of the base frame shown in FIG. 11.

FIGS. 5, 6 and 7 show the components stacked in order of assembly. This unit was designed to accommodate any size person without adjustment. Once the user has properly positioned himself laying on the table with his feet in the pockets 8 contoured into the table FIGS. 2, 8 and 9, he activates a hand held control switch which actuates the cylinder 20 shown in FIG. 1. As the table begins to pivot on its horizontal axis 36 shown in FIG. 1, the foot end of the table rises allowing the weighted vertical shaft 1 shown in FIGS. 1, 2, 3 and 5 to descend through the tube 12 (shown in FIGS. 1, 2 and 6) until the horizontal member 2 (shown in FIGS. 1, 2, 3 and 5) rests upon the users instep. As the foot end 39 of the table in FIG. 2 continues to rise, the coiled spring 53 in FIGS. 3 and 5 decompresses pushing the ball bearing 51 (shown in FIGS. 3 and 5) into the wedge formed on one side by the ramp 4 machined into the T-bar vertical shaft 1 (shown in FIGS. 2 and 5) and on the other side by the inside of the slip tube 12 in FIGS. 1, 2 and 6 locking the shaft of the T-bar at it's lowest point of descent.

When the user wishes to descend, he opens a bleed valve in the hydraulic system via remote control. As the table nears the horizontal rest position, the alignment yoke 30 in FIGS. 1, 2, 4, 7 and 12 guides the slip tube 12 in FIGS. 1, 2 and 6 to its seat.

Figure 3:
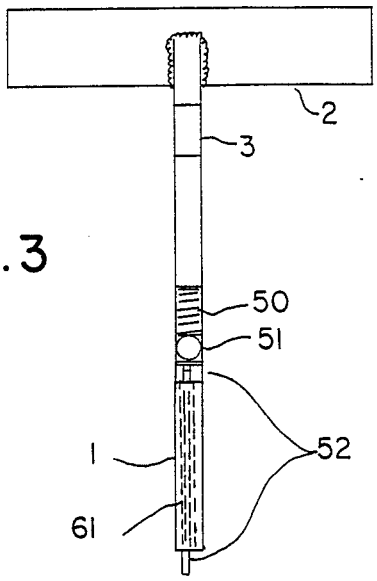
FIG. 3 is an enlarged front view of the foot embracing mechanism with releasable locking system.
Figure 4:
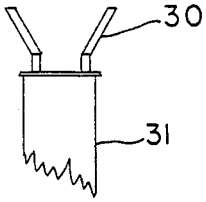
FIG. 4 shows a front view of the table alignment yoke as mounted on a vertical base frame member.

The end of the follower pin 52 in FIGS. 3 and 5 now descending vertically comes in contact with the top of the forward vertical post 31 as shown in FIGS. 4 and 7. Thus, as the table descends the last few degrees to a horziontal plane, the follower pin 52 in FIGS. 3 and 5 is pushed upward in its bore 61, forcing the ball bearing 51 in FIGS. 3 and 5, out of the wedge in FIG. 5 releasing the lock on the T-bar vertical shaft 1 in FIG. 1 allowing it to telescope upward, releasing the users lower extremities. Number 3 in FIGS. 3 and 5 is a stop to limit the travel of the T-bar shaft and accidental loss of the ball and spring assembly.

SUMMARY

There were several factors involved in the design of the table unit and the base unit that former products in the art have not thoroughly addressed.

Versatility—this machine needs no fitting or adjusting. The design will accommodate virtually anybody of any size or weight.

Aesthetics—clean, simple contours and lines.

Safety—the wide stance of the base frame makes this unit extremely stable. The single supporting post FIG. 1 number 35 positioned under the center of rotating table FIG. 1 number 55 makes it impossible to get limbs entangled in any counter rotating or shear forces. While design of the base unit combined with the contours of the table make the machine comfortable and easy to position the user on. In order to build the machine with a chair height bed I found it necessary to off-center the horizontal pivot axis requiring an independent power source. A side safety feature is a gravity return to the horizontal position. Thus the machine can be effortlessly and safely operated independently by the user.

COMPONENTS

1—T-bar Vertical shaft
2—T-bar Horizontal tube
3—T-bar Directional stop
4—Machined ramp
5—Contoured and molded table top
6—Longitudinal radii in table top
7—Side cuts
8—Molded foot pockets
9—Slip tube opening
12—Slip tube
13—Right angle table supports
14—Table sub frame main beam
15—Upper cylinder anchor
16—Table frame pivot yoke
17—Table frame cross member
18—Bed axis pivot pin
19—Cylinder pivot pin
20—Hydraulic cylinder
30—Bed alignment yoke
31—Forward vertical support post
32—Base frame forward tubular cross member
33—Base frame tubular main horizontal beam
34—Base frame horizontal tubular cross member
35—Base frame main vertical post
36—Horizontal bed axis
37—Main post reinforcing box section
39—Foot rest and bottom section of foot lock
40—Base frame cylinder pivot bracket
45—Tubular base frame
50—Table sub frame
51—Ball bearing
52—Ball bearing follower pin
53—Coil spring
55—Table/bed unit assembled
60—Foot embracing T-bar unit/with automatic releasable lock
61—Bore

I claim:

1. A slant board inversion table, comprising:

a frame;

a table top having an opening therein, said table top being pivotally connected with said frame for supporting a body;

tilting means for causing pivotal movement of said table top between a normal horizontal position and an inclined position;

a T-bar for securing a users feet on said table top which passes through said opening in said table, wherein the bottom of said T-bar contacts said frame when said table top is in said horizontal position thereby causing said T-bar to slide upwardly through said opening in said table top, said T-bar having an inclined surface; and locking means for locking said T-bar when said table top is in said inclined position and for automatically unlocking said T-bar when said table top is in said horizontal position, wherein said locking means comprises: a slip tube located under said opening, part of said T-bar being located inside said slide tube; a ball bearing located between said inclined surface of said T-bar and an inner surface of said slip tube; a spring for biasing said ball bearing and wedging said ball bearing between said inclined surface of said T-bar and said inside surface of said slip tube to wedge said T-bar against said inner surface of said slip tube; and a ball bearing follower pin located inside of said T-bar, one end of said pin being in contact with said ball bearing and the other end of said pin being in contact with said frame when said table is in said normal horizontal position, wherein said pin pushes said ball bearing against the bias of said spring when said table is in said normal position to unwedge or disengage said ball bearing from between said inclined surface of said T-bar and said inner surface of said slip tube to allow said T-bar to slide upwardly through said opening in said table when the bottom of said T-bar contacts said frame.

2. The slant board inversion table of claim 1, wherein said frame further comprises a bed alignment yoke for aligning said T-bar and said slip tube on the top of a vertical support post when said table top is moved from said inclined to said horizontal position.

3. A slant board inversion table comprising:

a frame;

a contour table top having a main portion for supporting the buttocks and torso of a user, a foot supporting portion and a narrow portion located between said main portion and said foot supporting portion;

pivot means located under said main portion of said contour table top for pivotally connecting said contour table top with said frame;

tilting means for causing pivotal movement of said table top between a normal horizontal position and an inclined non-vertical position;

a T-bar which passes through an opening in said foot supporting portion of said contour table top for restraining the feet of a user of said slant board inversion table; and locking means for locking said T-bar when said table top is in said inclined position and for automatically unlocking said T-bar when said table top is in said horizontal position, wherein said locking means comprises: a slip tube located under said opening, part of said T-bar extending from the bottom of said slip tube; a ball bearing located between an inclined surface of said T-bar and an inner surface of said slip tube; a spring biasing and wedging said ball bearing downwardly between said inclined surface of said T-bar and said inside surface of said slip tube to wedge said T-bar against said inner surface of said slip tube to prevent said T-bar from sliding in said slip tube; and an elongated ball bearing follower pin located inside of said T-bar, one end of said pin being in contact with the lower side of said ball bearing and the other end of said pin being in contact with said frame when said table is in said normal horizontal position, wherein said pin pushes said ball bearing against the bias of said spring when said table is in said normal position to unwedge or disengage said ball bearing from between said incline surface of said T-bar and said inner surface of said slip tube to allow said T-bar to slide upwardly through said opening in said table when the bottom of said T-bar contacts said frame and wherein said pin drops downwardly within said T-bar by the force of gravity when said pin is disengaged from said frame.

4. The slant board inversion table of claim 3, wherein said T-bar further contains a directional stop (3) which limits the downward sliding of said T-bar through said opening.

* * * * *